US010941922B2

(12) United States Patent
Benn

(10) Patent No.: US 10,941,922 B2
(45) Date of Patent: Mar. 9, 2021

(54) THREADLESS MAGNETIC LIGHTBULB AND SOCKET SYSTEM

(71) Applicant: Llewellyn Richard Benn, Brooklyn, NY (US)

(72) Inventor: Llewellyn Richard Benn, Brooklyn, NY (US)

( * ) Notice: Subject to any disclaimer, the term of this patent is extended or adjusted under 35 U.S.C. 154(b) by 176 days.

(21) Appl. No.: 16/087,330

(22) PCT Filed: Mar. 20, 2017

(86) PCT No.: PCT/US2017/023203
§ 371 (c)(1),
(2) Date: Sep. 21, 2018

(87) PCT Pub. No.: WO2017/165291
PCT Pub. Date: Sep. 28, 2017

(65) Prior Publication Data

US 2020/0292154 A1 Sep. 17, 2020

Related U.S. Application Data

(60) Provisional application No. 62/312,270, filed on Mar. 23, 2016.

(51) Int. Cl.
*F21V 17/10* (2006.01)
*F21V 23/06* (2006.01)
(Continued)

(52) U.S. Cl.
CPC ..... *F21V 17/105* (2013.01); *F21V 23/06* (2013.01); *H01R 13/6205* (2013.01); *H01R 33/18* (2013.01)

(58) Field of Classification Search
CPC ... F21V 17/105; F21V 23/06; H01R 13/6205; H01R 33/18
See application file for complete search history.

(56) References Cited

U.S. PATENT DOCUMENTS 2,788,501 A 4/1957 Buquor et al.
6,380,683 B1 * 4/2002 Kahn ..... H01J 5/50 315/56
(Continued)

FOREIGN PATENT DOCUMENTS

CN 2696118 Y 4/2005
FR 2111345 A7 6/1972

OTHER PUBLICATIONS

International Search Report for PCT/US17/23203 dated Jun. 12, 2017, 1 pg.
(Continued)

*Primary Examiner* — Donald L Raleigh
(74) *Attorney, Agent, or Firm* — Lathrop GPM LLP

(57) ABSTRACT

A threadless magnetic lightbulb and socket system includes a lightbulb base having a neck with a threadless exterior surface and a socket having a receptacle with a threadless interior surface configured to receive the neck. A first magnet is positioned at a tip of the lightbulb base and a second magnet is positioned in the receptacle of the socket such that the first magnet and the second magnet are configured to attract each other to magnetically retain the lightbulb within the socket. A threadless magnetic lightbulb includes a lightbulb base having a neck with a threadless exterior surface and a magnet positioned at a tip of the lightbulb base. A threadless magnetic socket includes a socket having a receptacle with a threadless interior surface configured to receive a lightbulb base and a magnet positioned in the receptacle of the socket.

14 Claims, 10 Drawing Sheets

(51) Int. Cl.
*H01R 13/62* (2006.01)
*H01R 33/18* (2006.01)

(56) References Cited

U.S. PATENT DOCUMENTS

| | | | | |
|---|---|---|---|---|
| 2010/0068899 | A1 | 3/2010 | Shvili | |
| 2014/0099801 | A1* | 4/2014 | Liao ..... | H01R 13/6205 439/39 |
| 2016/0079701 | A1 | 3/2016 | Sheng-Hsin | |

OTHER PUBLICATIONS

European Patent Application No. 17770905.2, Extended Search and Opinion dated Oct. 14, 2019, 9 pages.

* cited by examiner

THREADLESS MAGNETIC LIGHTBULB AND SOCKET SYSTEM

RELATED APPLICATIONS

This application claims priority to U.S. Patent Application Ser. No.: 62/312,270, filed on Mar. 23, 2016, and incorporated herein by reference.

BACKGROUND

Lightbulbs typically include threads around a neck for threading into a socket. The threads retain the lightbulb within the socket and allow insertion and removal of the lightbulb by rotation and counter-rotation, respectively.

SUMMARY

According to an embodiment, a threadless magnetic lightbulb and socket system is provided. The system includes a lightbulb base having a neck with a threadless exterior surface, a socket having a receptacle with a threadless interior surface configured to receive the neck, and a first magnet positioned at a tip of the lightbulb base. The system further includes a second magnet positioned in the receptacle of the socket such that the first magnet and the second magnet are configured to attract each other to magnetically retain the lightbulb within the socket.

According to another embodiment, a threadless magnetic lightbulb is provided. The threadless magnetic lightbulb includes a lightbulb base having a neck with a threadless exterior surface and a magnet positioned at a tip of the lightbulb base.

According to yet another embodiment, a threadless magnetic socket is provided. The threadless magnetic socket has a receptacle with a threadless interior surface configured to receive a lightbulb base and a magnet positioned in the receptacle of the socket.

DETAILED DESCRIPTION OF THE EMBODIMENTS

Figure 1:
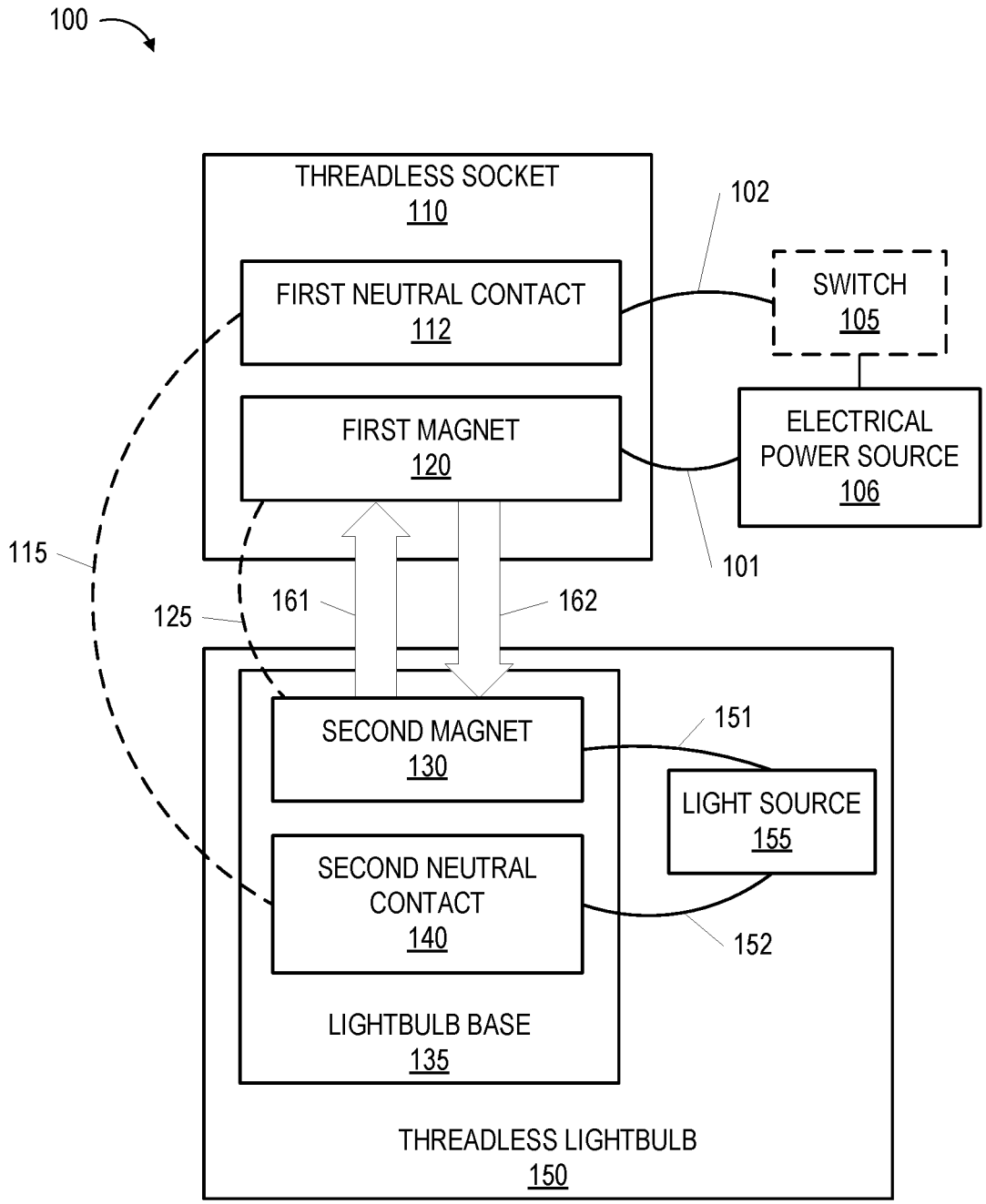
FIG. 1 is a block diagram illustrating a threadless magnetic lightbulb and a threadless magnetic socket, in an embodiment.

FIG. 1 is a block diagram illustrating an exemplary system 100 for a threadless magnetic lightbulb and socket. System 100 includes a threadless socket 110 having a first magnet 120 and a threadless lightbulb 150 having a second magnet 130. Threadless socket 110 may be located in any lighting fixture, such as a lamp, a ceiling light, or a spot light for example. Threadless lightbulb 150 may represent any type of lightbulb, such as incandescent, compact fluorescent, light-emitting diode (LED), or gas discharge for example. In an embodiment, threadless lightbulb 150 has a lightbulb base 135 with a neck that has a threadless exterior surface (see e.g., FIGS. 6, 10 and 12), and threadless socket 110 has a receptacle with a threadless interior surface (see e.g., FIGS. 4 and 8) configured to receive the neck (see e.g., FIG. 7).

First and second magnets 120, 130 are examples of a permanent magnet that produces a magnetic field, which pulls on other ferromagnetic materials such as iron, and attracts or repels other magnets. In an embodiment, first and second magnets 120, 130 are compact high-strength magnets made from rare Earth elements, such as a neodymium-iron-boron magnet. First magnet 120 is configured to magnetically attract second magnet 130 towards first magnet 120 as depicted by arrow 161. Likewise, second magnet 130 is configured to magnetically attract first magnet 120 towards second magnet 130 as depicted by arrow 162. In other words, first and second magnets 120, 130 are arranged with the north pole of one magnet aligned with the south pole of the other magnet to attract each other. First and second magnets 120, 130 attract each other to magnetically retain threadless lightbulb 150 within threadless socket 110 without overlapping threads therebetween. The magnetic attraction is for example strong enough to prevent threadless lightbulb 150 from falling due to its weight when arranged beneath threadless socket 110 with respect to gravity.

FIG. 1 illustrates electrical connections required for threadless lightbulb 150 to function. For example, an electrical connection 125 electrically connects first magnet 120 with second magnet 130 by direct contact therebetween when threadless lightbulb 150 is placed within threadless socket 110. Electrical connections 101 and 102 electrically connect first magnet 120 and a first electrical contact 112 to an electrical power source 106. Electrical power source 106 may be an alternating current (AC) electrical power source or a direct current (DC) power source, such as a battery for example. In embodiments, an optional switch 105 connects electrical power source 106 to first electrical contact 112, and first electrical contact 112 is a neutral contact. Switch 105 allows opening and closing of the electrical circuit to turn threadless lightbulb 150 off and on, respectively. Switch 105 may be located within socket 110 or outside socket 110 without departing from the scope hereof. In certain alternate embodiments, switch 105 is omitted and first magnet 120 is directly electrically connected to first electrical contact 112. Electrical connections 101, 102 may be made from electrically conductive (e.g., copper) wires and connected via soldering for example.

Figure 7:
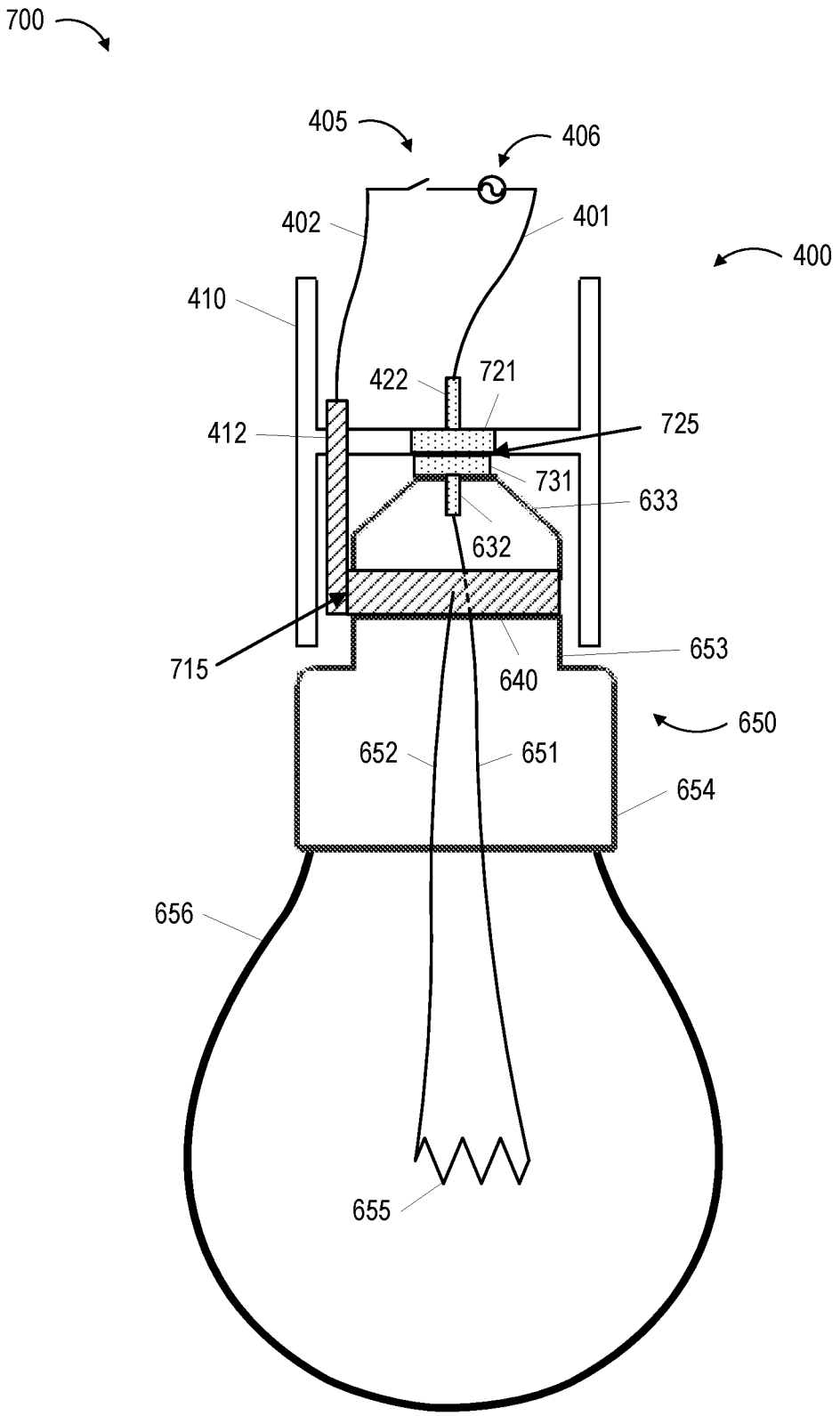
FIG. 7 schematically illustrates one embodiment of a threadless magnetic lightbulb and socket system, including the threadless magnetic socket of FIG. 4 and the threadless magnetic lightbulb of FIG. 6.

A direct electrical connection 115 connects first electrical contact 112, located within the receptacle of threadless socket 110, with a second electrical contact 140 of threadless lightbulb 150 by direct contact (see FIG. 7). In embodiments, second electrical contact 140 is a neutral contact. Electrical connection 151 connects second magnet 130 to a light source 155, and electrical connection 152 connects second electrical contact to light source 155. Light source 155 is for example a filament that makes light by becoming white hot when electrical current flows through, as in an incandescent lightbulb. Other types of light sources may be used in place of light source 155, such as light-emitting diodes, compact fluorescent lightbulbs and gas discharge lamps, without departing from the scope hereof.

Figure 2:
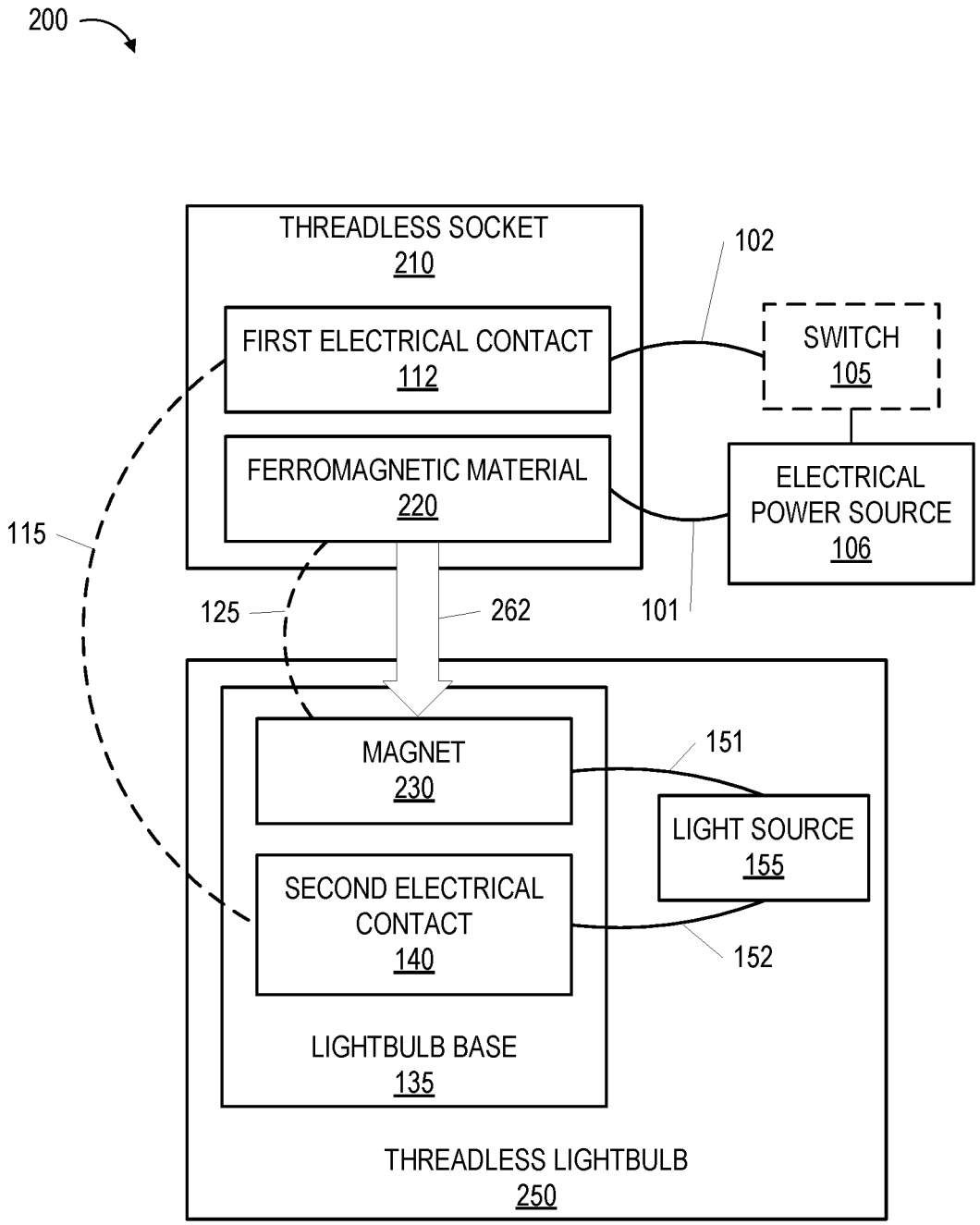
FIG. 2 is a block diagram illustrating a threadless magnetic lightbulb and a threadless socket, in an embodiment.

FIG. 2 is a block diagram illustrating an exemplary system 200 for a threadless magnetic lightbulb and socket. System 200 is an example of system 100, FIG. 1 that includes a threadless socket 210 having a ferromagnetic material 220 and a threadless lightbulb 250 having a magnet 230. Features of system 200 that are identical to system 100 are enumerated with like numerals. Accordingly, their description is not repeated here.

Magnet 230, which is an example of second magnet 130 of FIG. 1, is configured to magnetically attract ferromagnetic material 220 towards magnet 230 as depicted by arrow 262 to substantially maintain contact of threadless lightbulb 250 with threadless socket 210 without overlapping threads therebetween. Ferromagnetic material 220 is a material such as iron that is attracted to magnets due to ferromagnetism but that does not itself produce a magnetic field. Ferromagnetic material 220 may be ferromagnetic without departing from the scope hereof. The magnetic attraction indicated by arrow 262 is for example strong enough to prevent threadless lightbulb 250 from falling due to its weight when arranged beneath threadless socket 210 with respect to gravity.

Figure 3:
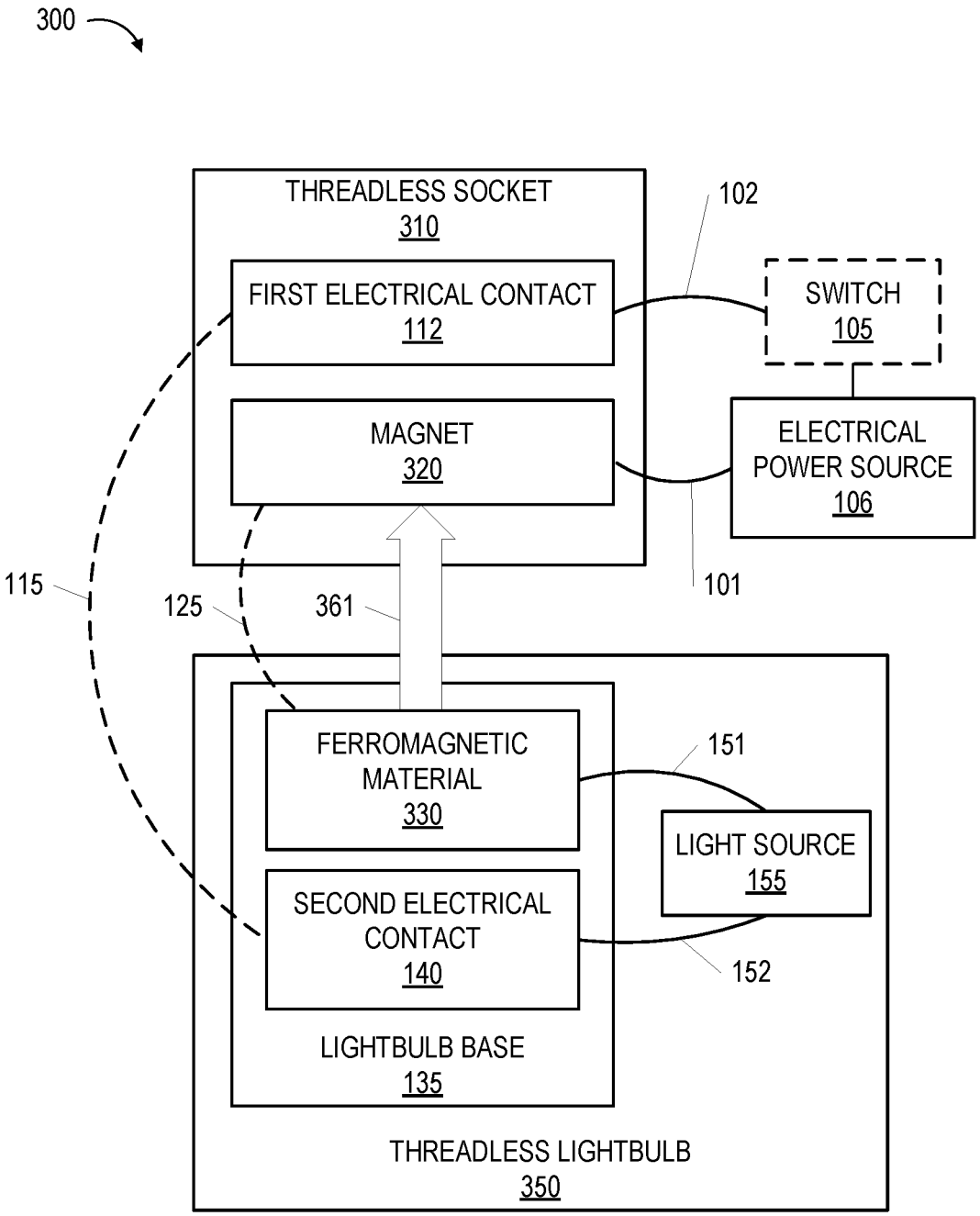
FIG. 3 is a block diagram illustrating a threadless lightbulb and a threadless magnetic socket, in an embodiment.

FIG. 3 is a block diagram illustrating an exemplary system 300 for a threadless magnetic lightbulb and socket. System 300 is an example of system 200, FIG. 2 that includes a threadless socket 310 having a magnet 320 and a threadless lightbulb 350 having a ferromagnetic material 330. Features of system 300 that are identical to system 100 are enumerated with like numerals. Accordingly, their description is not repeated here.

Magnet 320, which is an example of first magnet 120 of FIG. 1, is configured to magnetically attract ferromagnetic material 330 towards magnet 320 as depicted by arrow 361 to substantially maintain contact of threadless lightbulb 350 with threadless socket 310 without overlapping threads therebetween. Ferromagnetic material 330 is an example of ferromagnetic material 220, FIG. 2. The magnetic attraction indicated by arrow 361 is for example strong enough to prevent threadless lightbulb 350 from falling due to its weight when arranged beneath threadless socket 310 with respect to gravity.

Systems 100, 200 and 300 enable changing of a lightbulb without rotation of the lightbulb into and out of a socket containing threads. Advantages include less time to replace the lightbulb and less user dexterity needed to change the lightbulb.

Figure 4:
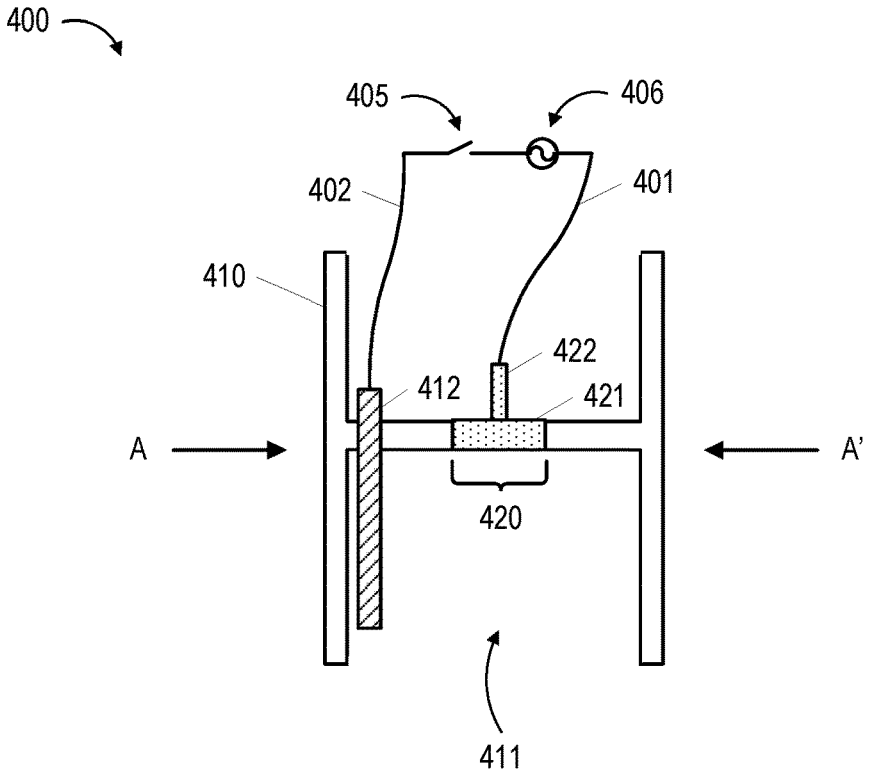
FIG. 4 is a cross-sectional side view illustrating a threadless magnetic socket, in an embodiment.
Figure 5:
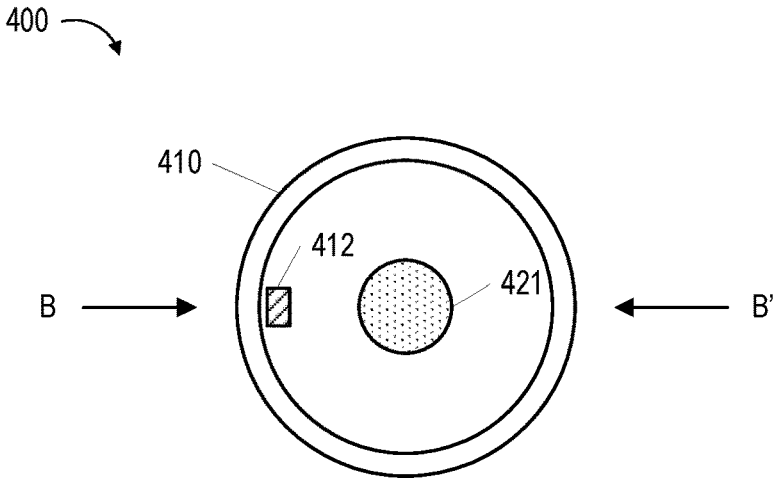
FIG. 5 is a cross-sectional bottom view illustrating the threadless magnetic socket of FIG. 4.

FIGS. 4 and 5 schematically illustrate an exemplary threadless magnetic socket 400, which is an example of threadless socket 110, FIG. 1. FIG. 4 shows a cross-sectional side view along the B-B' line of FIG. 5, and FIG. 5 shows a cross-sectional bottom view along the A-A' and orthogonal to the view of FIG. 4. Threadless magnetic socket 400 includes a housing 410 made of for example plastic or ceramic that has a receptacle 411 configured without threads for receiving a threadless lightbulb, such as threadless magnetic lightbulb 600, FIG. 6. A magnet 420, which is an example of first magnet 120, FIG. 1, is configured to attract a ferromagnetic material within receptacle 411. Magnet 420 includes a magnet base 421 and a pin 422 orthogonally coupled to magnet base 421. Magnet base 421 is a permanent magnet such as a compact high-strength neodymium-iron-boron magnet for example. Pin 422 is for example a metal such as copper that serves as an electrical contact.

An electrical power source 406 is an example of electrical power source 106, FIG. 1 connected to pin 422 via electrical connection 401, which is an electrically conductive wire for example. Electrical power source 406 may be a direct current (DC) power source, such as a battery for example, without departing from the scope hereof. A switch 405 connects electrical power source 406 to an electrical contact 412. In some alternate embodiments, switch 405 instead connects electrical power source 406 to pin 422. Switch is an example of switch 105, FIG. 1. Electrical contact 412 is made for example of metal and is positioned in receptacle 411 for contacting a corresponding electrical contact of a threadless lightbulb as shown in FIG. 7. Components of an exemplary threadless magnetic socket are shown in further detail in FIGS. 8 and 9.

Figure 6:
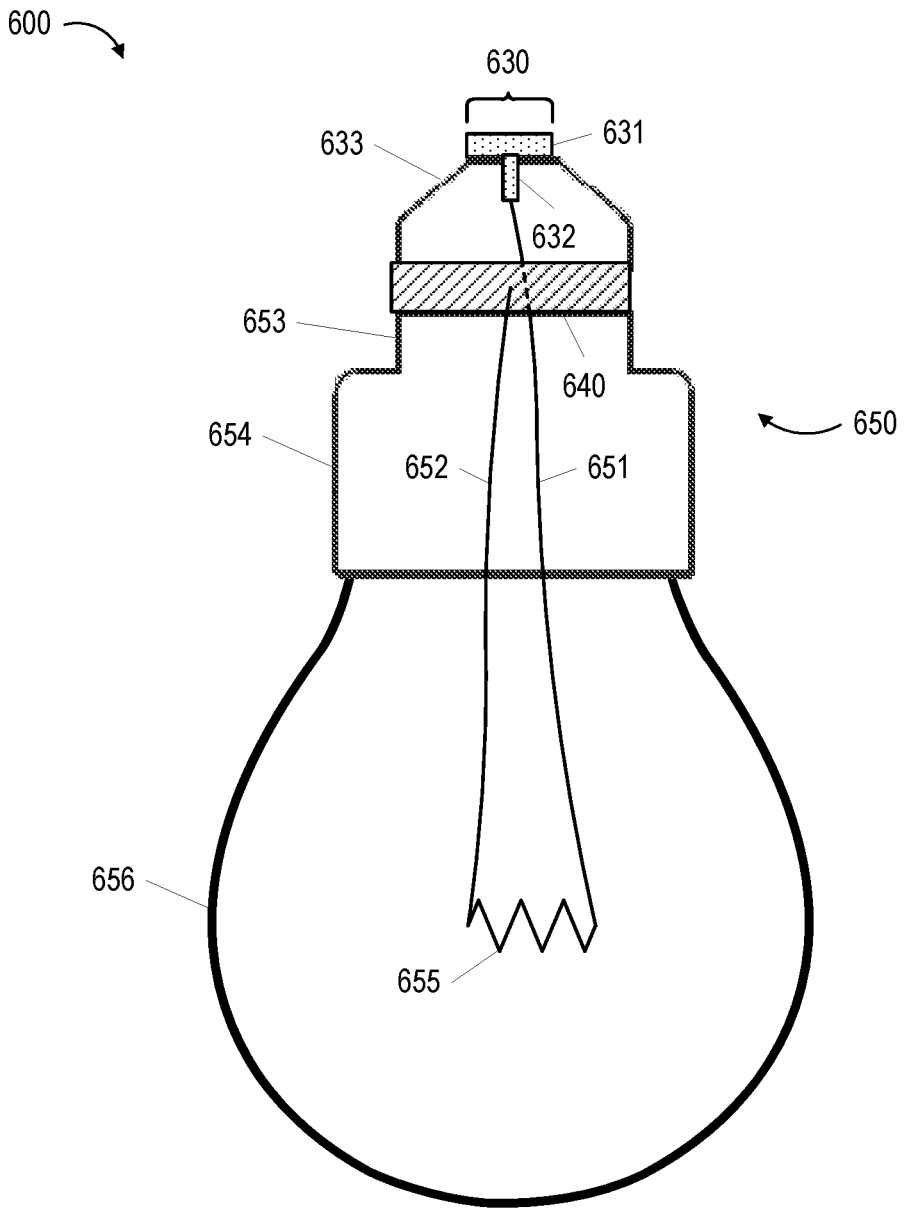
FIG. 6 schematically illustrates a threadless magnetic lightbulb, in an embodiment.

FIG. 6 schematically illustrates an exemplary threadless magnetic lightbulb 600, which is an example of threadless lightbulb 150, FIG. 1. Threadless magnetic lightbulb 600 includes a lightbulb base 650 and a bulb 656. Lightbulb base 650 includes a tip 633, a neck 653, and a base 654. Tip 633, neck 653, and base 654 may be monolithically molded of plastic or ceramic for example. Neck 653 has a threadless exterior surface. Located on an end of tip 633 is a magnet 630, which is an example of second magnet 130, FIG. 1, configured to attract a ferromagnetic material. Magnet 630 includes a magnet base 631 and a pin 632 orthogonally coupled to magnet base 631. Magnet base 631 is a permanent magnet such as a compact high-strength neodymium-iron-boron magnet for example. Pin 632 is for example a wire made of metal such as copper that serves as an electrical contact. Components of an exemplary lightbulb base are shown in further detail in FIGS. 10-12. A light source 655, such as a filament for example, is electrically coupled to pin 632 via a first electrical connection 651 and to an electrical contact ring 640 via a second electrical connection 652. Electrical contact ring 640 is made of a metal, such as galvanized steel for example, and configured coaxially around neck 653 for contact with electrical contact 412 of threadless magnetic socket 400 as shown in FIG. 7. In embodiments, electrical contact ring 640 is a neutral contact.

FIG. 7 schematically illustrates an exemplary system 700 for a threadless magnetic lightbulb and socket, which is an example of system 100, FIG. 1. System 700 illustrates threadless magnetic lightbulb 600, FIG. 6 magnetically and electrically coupled with threadless magnetic socket 400, FIGS. 4 and 5. System 700 includes a first magnet base 721 and a second magnet base 732, which are examples of magnet base 421, FIG. 4 and magnet base 631, FIG. 6, respectively. Direct contact 725 occurs between first magnet base 721 and second magnet base 731. Similarly, direct contact 715 occurs between electrical contact 412 and electrical contact ring 640. Either of first magnet base 721 or second magnet base 731 may be substituted with a ferromagnetic material that is attracted by magnets but does not itself produce a magnetic field without departing from the scope hereof. For example, ferromagnetic material 220, FIG. 2 may be substituted for first magnet base 721 to provide an example of system 200, FIG. 2. Similarly, ferromagnetic material 330, FIG. 3 may be substituted for second magnet base 731 to provide an example of system 300, FIG. 3.

Figure 8:
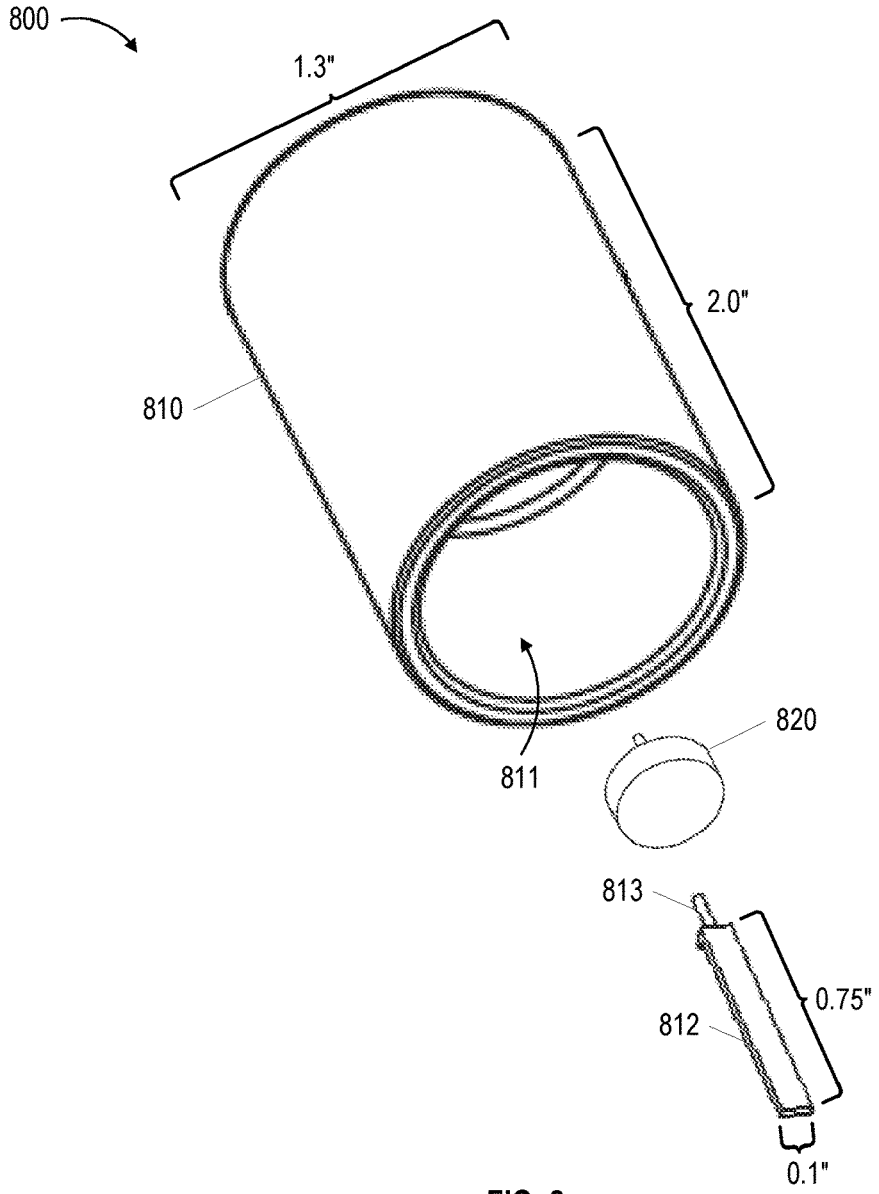
FIG. 8 is a schematic exploded view illustrating components of one threadless magnetic socket, in an embodiment.

FIG. 8 is a schematic exploded view illustrating components of a threadless magnetic socket 800, which is an example of threadless magnetic socket 400 of FIGS. 4, 5. Threadless magnetic socket 800 includes a housing 810, a magnet 820, and an electrical contact 812, which are examples of housing 410, magnet 420 and electrical contact 412 of FIGS. 4, 5. FIG. 8 shows magnet 820 and electrical contact 812 removed from housing 810 for clarity of illustration. Housing 810 includes a receptacle 811 configured without threads for receiving a threadless lightbulb, such as threadless magnetic lightbulb 600, FIG. 6. Magnet 820 is configured to attract a ferromagnetic material within receptacle 811, and electrical contact 812 is positioned in receptacle 411 for contacting electrical contact ring 640 of threadless magnetic lightbulb 600, FIG. 6. In an embodiment, housing 810 is about 2.0 inches long with an outer diameter of about 1.3 inch, and electrical contact 812 is about 0.1 inch wide by about 0.75 inch long and includes a tab 813 for connecting to housing 810.

Figure 9:
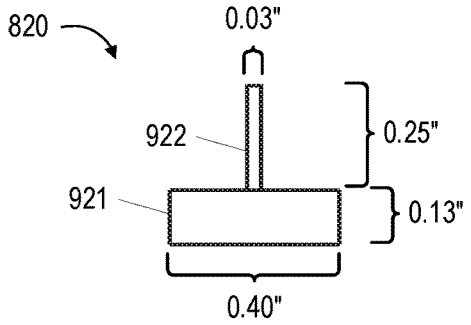
FIG. 9 schematically illustrates the magnet of FIG. 8 in further exemplary detail.

FIG. 9 schematically illustrates magnet 820, FIG. 8 in further exemplary detail. Magnet 820 includes a magnet base 921 and a pin 922 orthogonally coupled to magnet base 921. Magnet base 921 and pin 922 are examples of magnet base 421 and pin 422, FIG. 4, respectively. In an embodiment, pin 922 has a diameter of about 0.03 inch and a height of about 0.25 inch, and magnet base has a diameter of about 0.4 inch and a diameter of about 0.13 inch.

Figure 10:
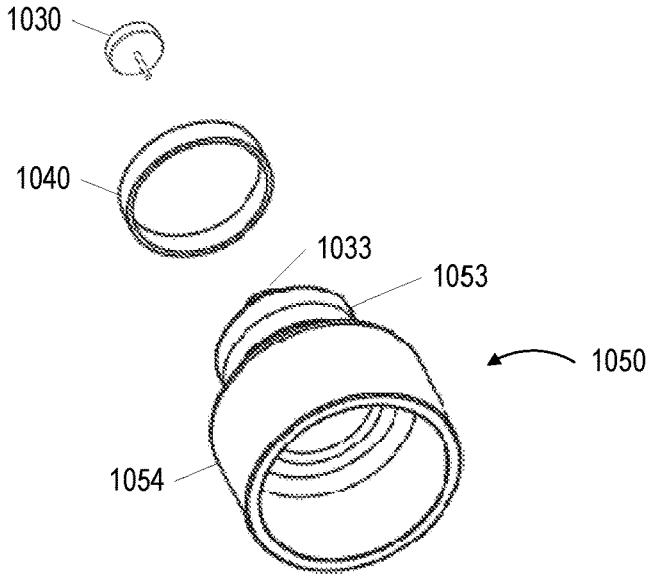
FIG. 10 is a schematic exploded view illustrating components of a lightbulb base from a threadless magnetic lightbulb, in an embodiment.

FIG. 10 is a schematic exploded view illustrating components of a lightbulb base 1050 with a magnet 1030 and an electrical contact ring 1040 removed for clarity of illustration. Lightbulb base 1050 is an example lightbulb base 650, FIG. 6 and includes a base 1054, a neck 1053, and a tip 1033, which are examples of base 654, neck 653, and tip 633, FIG. 6, respectively. Lightbulb base 1050 is configured to be coupled with magnet 1030 at tip 1033 and with electrical contact ring 1040 around neck 1053. Lightbulb base 1050 is shown in further exemplary detail in FIG. 12, described below. Electrical contact ring 1040 is an example of electrical contact ring 640, FIG. 6. In an embodiment, electrical contact ring 1040 has a height of about 0.18 inch, an outer diameter of about 1.04 inch and an inner diameter of about 0.97 inch and is made of galvanized steel.

Figure 11:
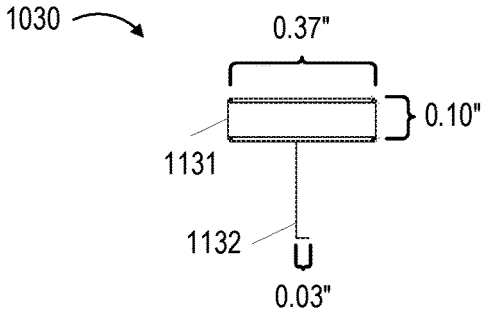
FIG. 11 schematically illustrates the magnet of FIG. 10 in further exemplary detail.

FIG. 11 schematically illustrates a side view of magnet 1030, FIG. 10 in further exemplary detail. Magnet 1030 is an example of magnet 630, with a magnet base 1131 and a pin 1132, which are examples of magnet base 631 and pin 632, FIG. 6. In an embodiment, magnet base 1131 has a height of about 0.1 inch and a diameter of about 0.37 inch, and pin 1132 has a diameter of about 0.03 inch.

Figure 12:
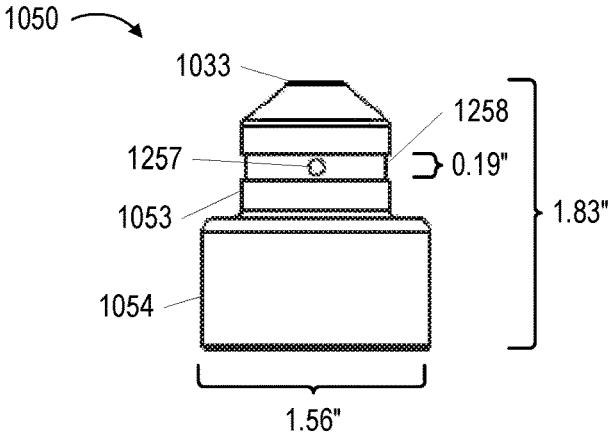
FIG. 12 schematically illustrates the lightbulb base of FIG. 10 in further exemplary detail.

FIG. 12 schematically illustrates a side view of lightbulb base 1050, FIG. 10 in further exemplary detail. Lightbulb base 1050 is a monolithic part molded of for example plastic and includes base 1054, neck 1053, and tip 1033. In an embodiment, lightbulb base 1050 has a length of about 1.83 inch and a diameter of about 1.56 inch. Neck 1053 has a narrow section 1258, which is for example about 0.19 inch wide. Narrow section 1258 is configured to accept electrical contact ring 1040. A hole 1257 is located in narrow section 1258 for providing a gap for an electrical connection to pass through lightbulb base 1050. For example, second electrical connection 652, FIG. 6 may electrically connect to electrical contact ring 1040 through hole 1257.

Figure 13:
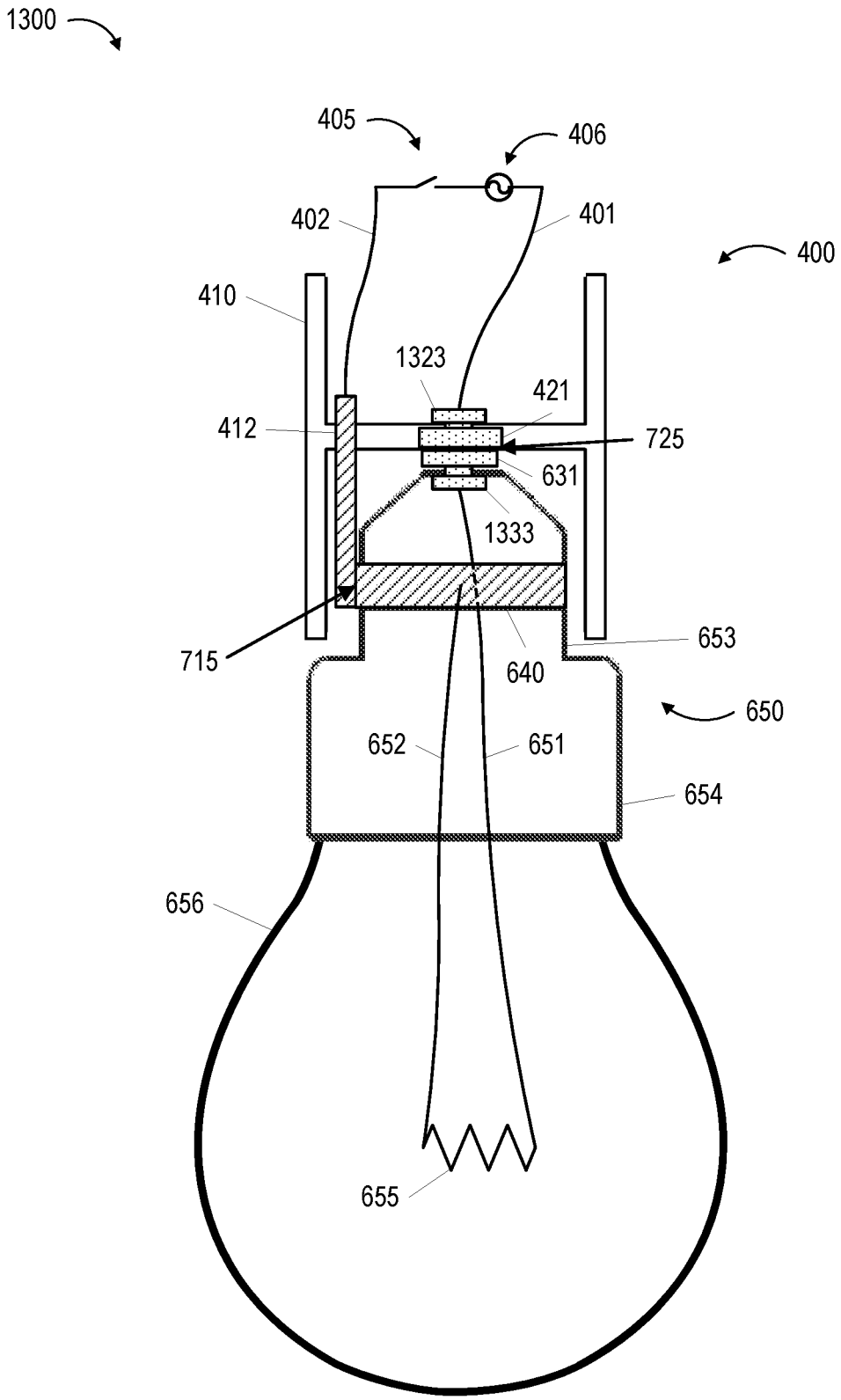
FIG. 13 schematically illustrates a threadless magnetic lightbulb and socket system, in an embodiment.

FIG. 13 schematically illustrates an exemplary system 1300 for a threadless magnetic lightbulb and socket, which is an example of system 700, FIG. 7. Features of system 1300 that are identical to system 700 are enumerated with like numerals. Accordingly, their description is not repeated here. System 1300 includes a flange 1323 coupled to magnet base 421 for affixing to housing 410. Similarly, system 1300 includes a flange 1333 coupled to magnet base 631 for affixing to lightbulb base 650. Electrical connection 401 connects directly to flange 1323 and first electrical connection 651 connects directly to flange 1333. Flange 1323 and flange 1333 are made of an electrically conductive material such as copper for example. An exemplary magnet base and flange are depicted in FIG. 14.

Figure 14:
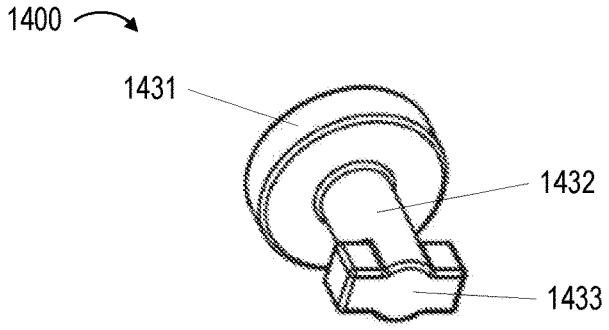
FIG. 14 schematically illustrates an exemplary magnet having a flange, in an embodiment.

FIG. 14 schematically illustrates a magnet 1400, including a magnet base 1431 and a pin 1432 coupled to magnet base 1431 having a flange 1433. Magnet base 1431 and pin 1432 are examples of magnet base 921 and pin 922, FIG. 9, respectively. Flange 1433, which is an example of flange 1323 and flange 1333, FIG. 13 may be inserted through a slot in a housing and rotated for affixing a magnet. For example, flange 1433 may be inserted in housing 810, FIG. 8 for affixing magnet base 1431. In an embodiment, magnet 1400 is configured for affixing to a tip of a lightbulb base, such as lightbulb base 650, FIG. 6.

Figure 15:
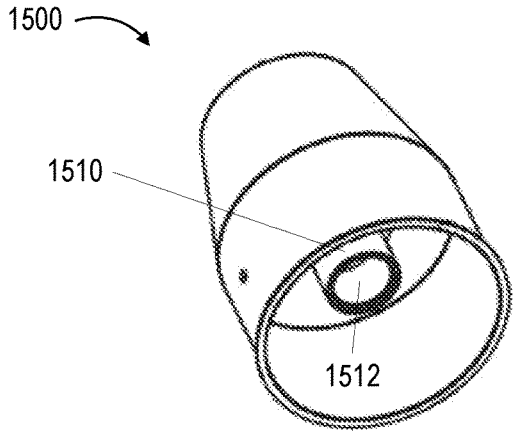
FIG. 15 shows a perspective view of an exemplary light fixture, in an embodiment.

FIG. 15 shows a perspective view of an exemplary light fixture 1500, which includes a socket housing 1510 having an electrical contact cylinder 1512 configured coaxially inside a portion of socket housing 1510 for electrical connecting with electrical contact ring 640, FIG. 6 of threadless magnetic lightbulb 600 for example. In embodiments, electrical contact cylinder 1512 is a neutral contact. Light fixture 1500 is configured to provide for example recessed ceiling lighting.

Figure 16:
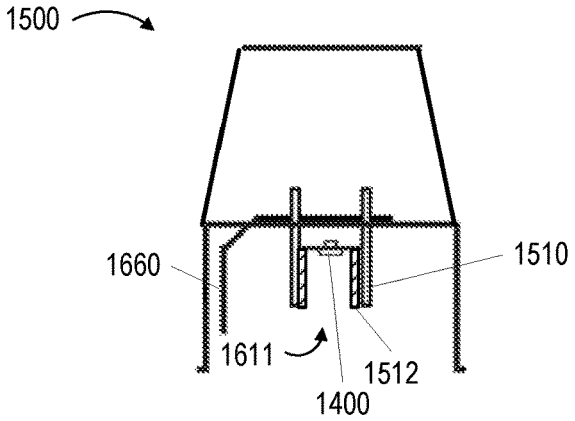
FIG. 16 shows a cross-sectional side view of the light fixture of FIG. 15.

FIG. 16 shows a cross-sectional side view of light fixture 1500, FIG. 15, including magnet 1400, socket housing 1510, and electrical contact cylinder 1512. Socket housing 1510 includes a receptacle 1611, which is an example of receptacle 811 of housing 810, FIG. 8, for receiving a threadless lightbulb, such as threadless magnetic lightbulb 600, FIG. 6. FIG. 16 further includes a bracket 1660, which may be magnetized to further retain a lightbulb base within light fixture 1500.

Combination of Features

Features described above as well as those claimed below may be combined in various ways without departing from the scope hereof. The following examples illustrate possible, non-limiting combinations the present invention has been described above, it should be clear that many changes and modifications may be made to the process and product without departing from the spirit and scope of this invention:

(A) A threadless magnetic lightbulb and socket system includes a lightbulb base having a neck with a threadless exterior surface, aa socket having a receptacle with a threadless interior surface configured to receive the neck, a first magnet positioned at a tip of the lightbulb base, and a second magnet positioned in the receptacle of the socket. The first magnet and the second magnet are configured to attract each other to magnetically retain the lightbulb within the socket.

(B) In the system denoted as (A), the first magnet being electrically connected to the second magnet by direct contact when the lightbulb is within the socket.

(C) In either of the systems denoted as (A) and (B), the neck comprises a hole through the lightbulb base for electrically connecting a first electrical contact.

(D) In any of the systems denoted as (A) through (C), the first electrical contact comprising a ring positioned coaxially around the neck.

(E) In any of the systems denoted as (A) through (D), the socket comprising a second electrical contact configured within the receptacle to electrically contact the first electrical contact.

(F) In the system denoted as (E), the second electrical contact comprising a cylinder positioned coaxially inside the receptacle.

(G) In any of the systems denoted as (A) through (F), the first magnet comprising a first flange configured to affix the first magnet at the tip of the lightbulb base, and the second magnet comprising a second flange configured to affix the second magnet within the receptacle of the socket.

(H) In any of the systems denoted as (A) through (G), the system further comprising a light fixture having a magnetized bracket, wherein the socket is positioned within the light fixture and the magnetized bracket further retains the lightbulb base within the socket.

(I) A threadless magnetic lightbulb, comprising a lightbulb base having a neck with a threadless exterior surface, and a magnet positioned at a tip of the lightbulb base.

(J) In the lightbulb denoted as (I), the ferromagnetic material at a socket electrically connecting the lightbulb to an electrical power source via the magnet when the ferromagnetic material directly contacts the magnet.

(K) In either of the lightbulbs denoted as (I) and (J), the neck comprises a hole through the lightbulb base for electrically connecting a first electrical contact.

(L) In the lightbulb denoted as (K), the first electrical contact comprising a ring positioned coaxially around the neck.

(M) In any of the lightbulbs denoted as (I) through (L), the magnet comprising a flange configured to affix the magnet at the tip of the lightbulb base.

(N) A threadless magnetic socket, having a receptacle with a threadless interior surface configured to receive a lightbulb base, and a magnet positioned in the receptacle of the socket.

(O) In the socket denoted as (N), the magnet electrically connecting the socket to an electrical power source for electrically powering the lightbulb via ferromagnetic material at the lightbulb when the magnet directly contacts the ferromagnetic material.

(P) In either of the sockets denoted as (N) and (O), the socket comprising an electrical contact configured within the receptacle to electrically contact the lightbulb base.

(Q) In any of the sockets denoted as (N) through (P), the electrical contact comprising a cylinder positioned coaxially inside the receptacle.

(R) In any of the sockets denoted as (N) through (Q), the magnet comprising a flange configured to affix the magnet within the receptacle of the socket.

(S) In any of the sockets denoted as (N) through (P), the socket further comprising a light fixture having a magnetized bracket, wherein the socket is positioned within the light fixture and the magnetized bracket further retains the lightbulb base within the socket.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which might be said to fall therebetween.

What is claimed is:

1. A threadless magnetic lightbulb and socket system, comprising:

a lightbulb base having a neck portion with a threadless exterior surface comprising an electrical contact ring;

a socket having a receiving portion with a threadless interior surface configured to receive the neck portion, said socket comprising an electrical contact making an electrical connection with the electrical contact ring when the lightbulb is inserted into the socket;

a first magnet positioned at a tip portion of the lightbulb base, said first magnet electrically connected to a light source; and a second magnet positioned in the receiving portion of the socket, said second magnet electrically connected to an electrical power source, wherein the first magnet and the second magnet are configured to attract each other to magnetically retain the lightbulb within the socket and wherein the first magnet is electrically connected to the second magnet by direct contact when the lightbulb is within the socket.

2. The system of claim 1, wherein the neck portion comprises a hole through the lightbulb base for electrically connecting the electrical contact ring with the light source.

3. The system of claim 1, wherein the electrical contact comprises a cylinder positioned coaxially inside the receiving portion.

4. The system of claim 1, wherein the first magnet comprises a first flange configured to affix the first magnet at the tip portion of the lightbulb base, and the second magnet comprises a second flange configured to affix the second magnet within the receiving portion of the socket.

5. The system of claim 1, further comprising a light fixture having a magnetized bracket, wherein the socket is positioned within the light fixture and the magnetized bracket further maintains the lightbulb base within the socket.

6. A threadless magnetic lightbulb, comprising:

a lightbulb base having a neck portion with a threadless exterior surface comprising an electrical contact ring positioned to electrically connect with an electrical contact in a socket when the lightbulb is inserted in the socket; and a magnet positioned at a tip portion of the lightbulb base, the magnet electrically connected with a light source, wherein the magnet is electrically connected to a magnet in the socket by direct contact when the lightbulb is within the socket.

7. The system of claim 6, wherein ferromagnetic material at the socket electrically connects the lightbulb to an electrical power source via the magnet when the ferromagnetic material directly contacts the magnet.

8. The system of claim 6, wherein the neck portion comprises a hole through the lightbulb base for electrically connecting the electrical contact ring with the light source.

9. The system of claim 6, wherein the magnet comprises a flange configured to affix the magnet at the tip portion of the lightbulb base.

10. A threadless magnetic socket, comprising:

a socket having a receiving portion with a threadless interior surface configured to receive a base of a lightbulb, said socket comprising an electrical contact making an electrical connection with an electrical contact ring around the base when the lightbulb is inserted into the socket; and a magnet positioned in the receiving portion of the socket, said magnet electrically connected to an electrical power source, wherein the magnet is electrically connected to the base by direct contact when the lightbulb is within the socket.

11. The threadless magnetic socket of claim 10, wherein the magnet electrically connects the socket to an electrical power source for electrically powering the lightbulb via ferromagnetic material at the lightbulb when the magnet directly contacts the ferromagnetic material.

12. The threadless magnetic socket of claim 10, wherein the electrical contact comprises a cylinder positioned coaxially inside the receiving portion.

13. The system of claim 10, wherein the magnet comprises a flange configured to affix the magnet within the receiving portion of the socket.

14. The threadless magnetic socket of claim 10, further comprising a light fixture having a magnetized bracket, wherein the socket is positioned within the light fixture and the magnetized bracket further maintains the base within the socket.

* * * * *